US006474422B2

(12) United States Patent
Schubert et al.

(10) Patent No.: US 6,474,422 B2
(45) Date of Patent: Nov. 5, 2002

(54) METHOD FOR CONTROLLING A WELL IN A SUBSEA MUDLIFT DRILLING SYSTEM

(75) Inventors: Jerome J. Schubert, College Station, TX (US); Carmon H. Alexander, Jonesboro, TX (US); Hans C. Juvkam-Wold, College Station, TX (US); Curtis E. Weddle, III, Magnolia, TX (US); Jonggeun Choe, Seoul (KR)

(73) Assignees: Texas A&M University System, College Station, TX (US); Conoco, Inc., Houston, TX (US)

( * ) Notice: Subject to any disclaimer, the term of this patent is extended or adjusted under 35 U.S.C. 154(b) by 0 days.

(21) Appl. No.: 09/731,294

(22) Filed: Dec. 6, 2000

(65) Prior Publication Data

US 2002/0066571 A1 Jun. 6, 2002

(51) Int. Cl.[7] ..... E21B 21/14

(52) U.S. Cl. ..... 175/69; 175/25; 175/38; 175/48; 175/72

(58) Field of Search ..... 175/25, 38, 48, 175/65, 69, 72; 166/358, 359, 363

(56) References Cited

U.S. PATENT DOCUMENTS

| | | | | |
|---|---|---|---|---|
| 3,976,148 A | | 8/1976 | Maus et al. | 175/7 |
| 4,046,191 A | * | 9/1977 | Neath | |
| 4,063,602 A | * | 12/1977 | Howell et al. | |
| 4,709,900 A | * | 12/1987 | Dyhr | |
| 4,813,495 A | | 3/1989 | Leach | 175/6 |
| 6,032,742 A | | 3/2000 | Tomlin et al. | 166/345 |
| 6,102,673 A | | 8/2000 | Mott et al. | 417/392 |
| 6,216,799 B1 | | 4/2001 | Gonzalez | 175/5 |
| 6,263,981 B1 | | 7/2001 | Gonzalez | 175/5 |
| 6,276,455 B1 | | 8/2001 | Gonzalez | 166/357 |
| 6,325,159 B1 | | 12/2001 | Peterman et al. | 175/7 |

OTHER PUBLICATIONS

Excerpt from WorldOil.com–Online Magazine–Special Focus entitled, "Subsea MudLift Drilling JIP: Achieving dual–gradient technology", dated Aug. 1999, 8 pages.

J. Choe et al., "Well Control Aspects of Riserless Drilling", Society of Petroleum Engineers Paper No. SPE 49058 dated Sep. 1998, 12 pages.

H. R. Lima et al., "Pressure Calculations and Kick Detection with Synthetic–Based Muds in a Riserless Drilling Configuration", Offshore Technology Conference paper No. OTC 10897 dated May 1999, 12 pages.

H. R. Lima et al., "Computational Hydraulic Analysis of a Deepwater Well Drilled with Synthetic–Based Mud in a Riserless Drilling Configuration", Society of Petrolem Engineers Paper No. SPE 49057 dated Sep. 1998, 6 pages.

Presentation by Hans C. Juvkam–Wold, Texas A&M University entitled "How Does Riserless Drilling Differ from Drilling with a Conventional Riser?", dated Nov. 20, 1997, 40 pages.

Presentation by Hans C. Juvkam–Wold and Jonggeun Choe, Texas A&M University entitled "A Comparison Between Riserless Drilling and Conventional Drilling", dated Jul. 30, 1997, 34 pages.

* cited by examiner

*Primary Examiner*—Roger Schoeppel
(74) *Attorney, Agent, or Firm*—Rosenthal & Osha L.L.P.

(57) ABSTRACT

A method for controlling a subsea well that includes shutting at least one blowout preventer, opening at least one isolation line, and circulating an influx out of a well while an inlet pressure of a subsea mudlift pump is adjusted to maintain a substantially constant drill pipe pressure at an initial circulating pressure. After the influx is circulated out of the well, drilling mud with a kill mud weight is pumped into the well. The drill pipe pressure is reduced according to a preselected drill pipe pressure decline schedule until the kill mud weight drilling mud reaches the bottom of the well. The drill pipe pressure is then maintained at a final circulating pressure by adjusting the inlet pressure of the subsea mudlift pump. The kill mud weight drilling mud is then circulated from the well bottom to the surface at the final circulating pressure.

45 Claims, 4 Drawing Sheets

METHOD FOR CONTROLLING A WELL IN A SUBSEA MUDLIFT DRILLING SYSTEM

BACKGROUND OF THE INVENTION

1. Technical Field

The invention relates generally to methods and procedures for maintaining well control during drilling operations. More specifically, the invention relates to methods and procedures where "riserless" drilling systems are used.

2. Background Art

Exploration companies are continually searching for methods to make deep water drilling commercially viable and more efficient. Conventional drilling techniques are not feasible in water depths of over several thousand feet. Deep water drilling produces unique challenges for drilling aspects such as well pressure control and wellbore stability.

Deep Water Drilling

Deep water drilling techniques have, in the past, typically relied on the use of a large diameter marine riser to connect drilling equipment on a floating vessel or a drilling platform to a blowout preventer stack on a subsea wellhead disposed on the seafloor. The primary functions of the marine riser are to guide a drill string and other tools from the floating vessel to the subsea wellhead and to conduct drilling mud and earth cuttings from a subsea well back to the floating vessel. In deeper waters, conventional marine riser technology encounters severe difficulties. For example, if a deep water marine riser is filled with drilling mud, the drilling mud in the riser may account for a majority of the drilling mud in the circulation system. As water depth increases, the drilling mud volume increases. The large volume of drilling mud requires an excessively large circulation system and drilling vessel. Moreover, an extended length riser may experience high loads from ocean currents and waves. The energy from the currents and waves may be transmitted to the drilling vessel and may damage both the riser and the vessel.

In order to overcome problems associated with deep water drilling, a technique known as "riserless" drilling has been developed. Not all riserless techniques operate without a marine riser. The marine riser may still be used for the purpose of guiding the drill string to the wellbore and for protecting the drill string and other lines that run to and from the wellbore. When marine risers are used, however, they typically are filled with seawater rather than drilling mud. The seawater has a density that may be substantially less than that of the drilling mud, substantially reducing the hydrostatic pressure in the drilling system.

An example of a riserless drilling system is shown in U.S. Pat. No. 4,813,495 issued to Leach and assigned to the assignee of the present invention. A riserless drilling system 10 of the '495 patent is shown in FIG. 1 and comprises a drill string 12 including drill bit 20 and positive displacement mud motor 30. The drill string 12 is used to drill a wellbore 13. The system 10 also includes blowout preventer stack 40, upper stack package 60, mud return system 80, and drilling platform 90. As drilling is initiated, drilling mud is pumped down through the drill string 12 through drilling mud line 98 by a pump which forms a portion of mud processing unit 96. The drilling mud flow operates mud motor 30 and is forced through the bit 20. The drilling mud is forced up a wellbore annulus 13A and is then pumped to the surface through mud return system 80, mud return line 82, and subsea mudlift pump 81. This process differs from conventional drilling operations because the drilling mud is not forced upward to the surface through a marine riser annulus.

The blowout preventer stack 40 includes first and second pairs of ram preventers 42 and 44 and annular blowout preventer 46. The blowout preventers ("BOP"s) may be used to seal the wellbore 13 and prevent drilling mud from travelling up the annulus 13A. The ram preventers 42 and 44 include pairs of rams (not shown) that may seal around or shear the drill string 12 in order to seal the wellbore 13. The annular preventer 46 includes an annular elastomeric member that may be activated to sealingly engage the drill string 12 and seal the wellbore 13. The blowout preventer stack 40 also includes a choke/kill line 48 with an adjustable choke 50. The choke/kill line 48 provides a flow path for drilling mud and formation fluids to return to the drilling platform 90 when one or more of the BOPs (42, 44, and 46) have been closed.

The upper end of the BOP stack 40 may be connected to the upper stack package 60 as shown in FIG. 1. The upper stack package 60 may be a separate unit that is attached to the blowout preventer stack 40, or it may be the uppermost element of the blowout preventer stack 40. The upper stack package 60 includes a connecting point 62 to which mud return line 82 is connected. The upper stack package 60 may also include a rotating head 70. The rotating head 70 may be a subsea rotating diverter ("SRD") that has an internal opening permitting passage of the drill string 12 through the SRD. The SRD forms a seal around the drill string 12 so that the drilling mud filled annulus 13A of the wellbore 13 is hydraulically separated from the seawater. The rotating head 70 typically includes both stationary elements that attach to the upper stack package 40 and rotating elements that sealingly engage and rotate with the drill string 12. There may be some slippage between rotating elements of the rotating head 70 and the drill string 12, but the hydraulic seal is maintained. During drill pipe "trips" to change the bit 20, the rotating head 70 is typically tripped into the hole on the drill string 12 before fixedly and sealingly engaging the upper stack package 60 that is connected to the BOP stack 40.

The lower end of the BOP stack 40 may be connected to a casing string 41 that is connected to other elements (such as casing head flange 43 and template 47) that form part of a subsea wellhead assembly 99. The subsea wellhead assembly 99 is typically attached to conductor casing that may be cemented in the first portion of the wellbore 13 that is drilled in the seafloor 45. Other portions of the wellbore 13, including additional casing strings, well liners, and open hole sections extend below the conductor casing.

The mud return system 80 includes the subsea mudlift pump 81 that is positioned in the mud return line 82 adjacent to the upper stack package 60. The subsea mudlift pump 81 in the '495 patent is shown as a centrifugal pump that is powered by a seawater driven turbine 83 that is, in turn, driven by a seawater transmitting powerfluid line 84. The mud return system 80 boosts the flow of drilling mud from the seafloor 45 to the drilling mud processing unit 96 located on the drilling platform 90. Drilling mud is then cleaned of cuttings and debris and recirculated through the drill string 12 through drilling mud line 98.

Subsea Well Control

When drilling a well, particularly an oil or gas well, there exists the danger of drilling into a formation that contains fluids at pressures that are greater than the hydrostatic fluid pressure in the wellbore. When this occurs, the higher pressure formation fluids flow into the well and increase the fluid volume and fluid pressure in the wellbore. The influx of formation fluids may displace the drilling mud and cause the drilling mud to flow up the wellbore toward the surface. The formation fluid influx and the flow of drilling and formation fluids toward the surface is known as a "kick." If the kick is not subsequently controlled, the result may be a "blowout" in which the influx of formation fluids (which, for example, may be in the form of gas bubbles that expand near the surface because of the reduced hydrostatic pressure) blows the drill string out of the well or otherwise destroys a drilling apparatus. An important consideration in deep water drilling is controlling the influx of formation fluid from subsurface formations into the well to control kicks and prevent blowouts from occurring.

Drilling operations typically involve maintaining the hydrostatic pressure of the drilling mud column above the formation fluid pressure. This is typically done by selecting a specific drilling mud density and is typically referred to as "overbalanced" drilling. At the same time, however, the bottom hole pressure of the drilling mud column must be maintained below the formation fracture pressure. If the bottom hole pressure exceeds the formation fracture pressure, the formation may be damaged or destroyed and the well may collapse around the drill string.

A different type of drilling regime, known as "underbalanced" drilling, may be used to optimize the rate of penetration ("ROP") and the efficiency of a drilling assembly. In underbalanced drilling, the hydrostatic pressure of the drilling mud column is typically maintained lower than the fluid pressure in the formation. Underbalanced drilling encourages the flow of formation fluids into the wellbore. As a result, underbalanced drilling operations must be closely monitored because formation fluids are more likely to enter the wellbore and induce a kick.

Once a kick is detected, the kick is typically controlled by "shutting in" the wellbore and "circulating out" the formation fluids that entered the wellbore. Referring again to FIG. 1, a well is typically shut in by closing one or more BOPs (42, 44, and/or 46). The fluid influx is then circulated out through the adjustable choke 50 and the choke/kill line 48. The choke 50 is adjustable and may control the fluid pressure in the well by allowing a buildup of back pressure (caused by pumping drilling mud from the mud processing unit 96) so that the kick may be circulated through the drilling mud processing unit 96 in a controlled process. The drilling mud processing unit 96 has elements that may remove any formation fluids, including both liquids and gases, from the drilling mud. The drilling mud processing unit 96 then recirculates the "cleaned" drilling mud back through the drill string 12. Typically, as the kick is circulated out, the drilling mud that is being pumped back into the wellbore 13 through drill string 12 has an increased density of a preselected value. The resulting increased hydrostatic pressure of the drilling mud column may equal or exceed the formation pressure at the site of the kick so that further kicks are prevented. This process is referred to as "killing the well." The kick is circulated out of the wellbore and the drilling mud density is increased in substantially one complete circulation cycle (for example, by the time the last remnants of the drilling mud with the pre-kick mud density have been circulated out of the well, mud with the post-kick mud density has been circulated in as a substitute). When the wellbore is stabilized, drilling operations may be resumed or the drill string 12 may be tripped out of the wellbore 13. This method of controlling a kick is typically referred to as the "Wait and Weight" method. The Wait and Weight Method has historically been the preferred method of circulating out a kick because it generally exerts less pressure on the wellbore 13 and the formation and requires less circulating time to remove the influx from the drilling mud.

Another method for controlling a kick is typically referred to as the "Driller's Method." Generally, the Driller's Method is accomplished in two steps. First, the kick is circulated out of the wellbore 13 while maintaining the drilling mud at an original mud weight. This process typically takes one complete circulation of the drilling mud in the wellbore 13. Second, drilling mud with a higher mud weight is then pumped into the wellbore 13 to overcome the higher formation pressure that produced the kick. Therefore, the Driller's Method may be referred to as a "two circulation kill" because it typically requires at least two complete circulation cycles of the drilling mud in the wellbore 13 to complete the process.

A device known as a drill string valve ("DSV") may be used as a component of either of the previously referenced well control methods. A DSV is typically located near a bottom hole assembly and includes a spring activated mechanism that is sensitive to the pressure inside the drill string. When drill string pressure is lowered below a preselected level, the spring activates a flow cone that moves to block flow ports in a flow tube. In order for drilling mud to flow through the drill string, the flow ports must be at least partially open. Thus, the DSV permits flow through the drill string if sufficient surface pump pressure is applied to the drilling fluid column, and the DSV typically only permits flow in one direction so that it act as a check valve against mud flowing back toward the surface.

The spring pressure in the DSV may be adjusted to account for factors such as the depth of the wellbore, the hydrostatic pressure exerted by the drilling mud column, the hydrostatic pressure exerted by the seawater from a drilling mud line to the surface, and the diameter of drill pipe in the drill string. The drilling mud line may be defined as a location in a well where a transition from seawater to drilling mud occurs. For example, in the system 10 shown in FIG. 1, the drilling mud line is defined by the hydraulic seal of the rotating head 70 that separates the drilling mud of the wellbore annulus 13A from seawater. The DSV may be used to stop drilling mud from experiencing "free-fall" when the mud circulation pumps are shut down and the well is shut-in.

Using the system of the Leach '495 patent as an example, when the pumps of the mud processing unit 96 are shut down and no DSV is present in the drill string 12, the mud column hydrostatic pressure in the drill string 12 is greater than the sum of the hydrostatic pressure of the drilling mud in the wellbore annulus 13A and a suction pressure generated by the subsea mudlift pump 81. Drilling mud, therefore, free-falls in the drill string into the wellbore annulus 13A until the hydrostatic pressure of the mud column in the drill string 12 is equalized with the sum of the hydrostatic pressure of the drilling mud in the wellbore annulus 13A and the mudlift pump 81 suction pressure. Thus, the well continues to flow while equilibrium is established. The continued flow of drilling mud in the well after pump shut-down may typically be referred to as an "unbalanced U-tube" effect. The DSV, which should be in a closed position after the pumps are shut-down, may prevent the free-fall of drilling mud in the wellbore that may be attributable to the unbalanced U-tube.

In contrast, in conventional drilling systems where drilling mud is returned to the surface through the wellbore annulus, the drilling mud circulation system forms a "balanced U-tube" because there is no flow of drilling mud in the well after the surface pumps are shut down. The well does not flow because the hydrostatic pressure of the drilling mud in the drill string is balanced with the hydrostatic pressure of the mud in the wellbore annulus.

Well control procedures may be complicated by a leaking DSV. For example, the spring in the DSV must be adjusted correctly so that it will activate the flow cone and block the flow ports when pressure is removed from the mud column such as by shutting down the surface mud pumps. If the flow ports remain at least partially open, the well will continue to flow after all the pumps have been shut down and/or after the well has been fully shut-in. Further, the DSV may develop leaks from flow erosion, corrosion, or other factors.

Typically, there are two conditions where the DSV may be checked for leaks. The first condition is during normal drilling operations when, for example, circulation of drilling mud is stopped so that a drill pipe connection may be made (all pumps must be shut off for the DSV check). In this case, an effort is made to distinguish between a leaking DSV and a possible kick. The second condition occurs after the well has been fully shut-in on a kick (again, all pumps must be shut off for the DSV check). In this case, an effort is made to distinguish between a leaking DSV and additional flow that may have entered the well from the known kick. In both cases it is important to check the DSV for leaks because otherwise it may be difficult to determine if additional flow in the well is due to a leaking or partially open DSV or to additional flow that has entered the well from a kick.

Reliable methods are needed to quickly and efficiently control and eliminate kicks that are experienced when drilling wells. The methods must account for the special configurations of deepwater drilling systems and must function both with and without the use of a DSV. The methods must also be designed to determine the difference between a leaking DSV and a kick that may have occurred during drilling operations, and also between a leaking DSV and additional flow that may occur after a kick is shut-in. In either case, the kicks come from formations with pore pressures that exceed the fluid pressure in the wellbore. Finally, the methods should result in a hydrostatically "dead" well so that the drill string may be removed from the wellbore or so that drilling operations may resume.

SUMMARY OF THE INVENTION

One aspect of the invention is a method for controlling a subsea well including shutting at least one blowout preventer, opening at least one isolation line, and circulating a formation fluid influx out of a well while an inlet pressure of a subsea mudlift pump is adjusted to maintain a substantially constant drill pipe pressure at an initial circulating pressure. Kill weight drilling mud is pumped from the surface into the well, and the drill pipe pressure is reduced according to a preselected drill pipe pressure decline schedule until the kill weight drilling mud reaches a bottom of the well. After the kill weight drilling mud reaches the bottom of the well, the drill pipe pressure is maintained at a final circulating pressure by adjusting the inlet pressure of the subsea mudlift pump. Kill weight drilling mud is then circulated from the bottom of the well to the surface at the final circulation pressure.

In another aspect, the invention is a method for controlling a subsea well including shutting at least one blowout preventer, opening at least one isolation line, and circulating a formation fluid influx out of a well while an inlet pressure of a subsea mudlift pump is adjusted to maintain a substantially constant drill pipe pressure at an initial circulating pressure. Kill weight drilling mud is pumped from the surface into the well, and the inlet pressure of the subsea mudlift pump is held substantially constant until the kill weight drilling mud reaches a bottom of the well. The inlet pressure of the subsea mudlift pump is then adjusted to maintain the drill pipe pressure at a final circulating pressure. Kill weight drilling mud is then circulated from the bottom of the well to the surface at the final circulating pressure.

Other aspects and advantages of the invention will be apparent from the following description and the appended claims.

DETAILED DESCRIPTION

In an embodiment of the invention, a full shut-in of the well is carried out after a dynamic shut-in procedure, such as the procedure disclosed in co-pending U.S. application Ser. No. 09/731,295, titled "Method For Dynamic Shut-In of a Subsea Mudlift Drilling System," filed on even date herewith, assigned to the assignee of the present invention, and incorporated by reference herein.

Figure 1:
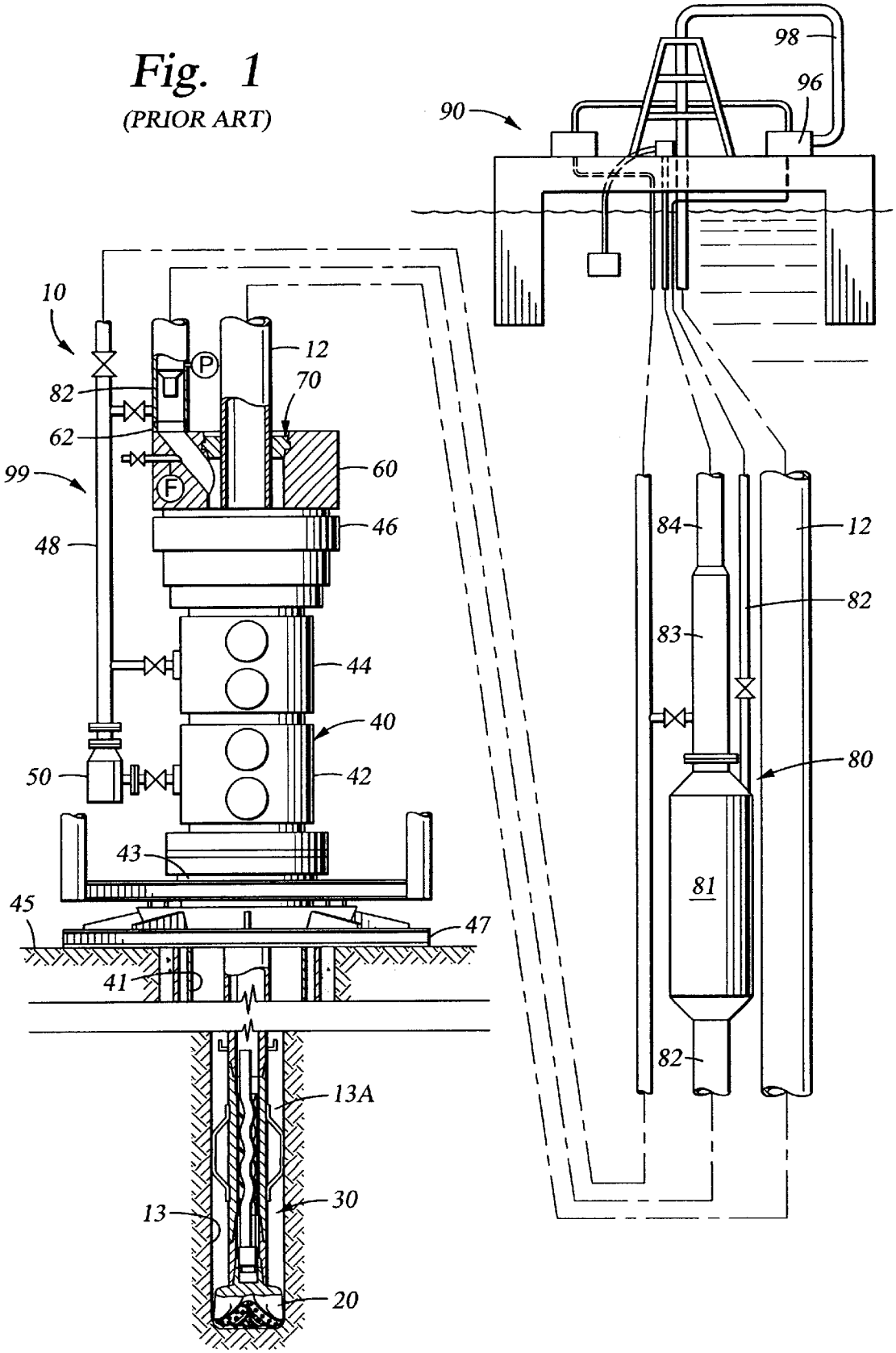
Fig. 1 (PRIOR ART)
FIG. 1 shows a schematic view of a prior art riserless drilling system.
Figure 2:
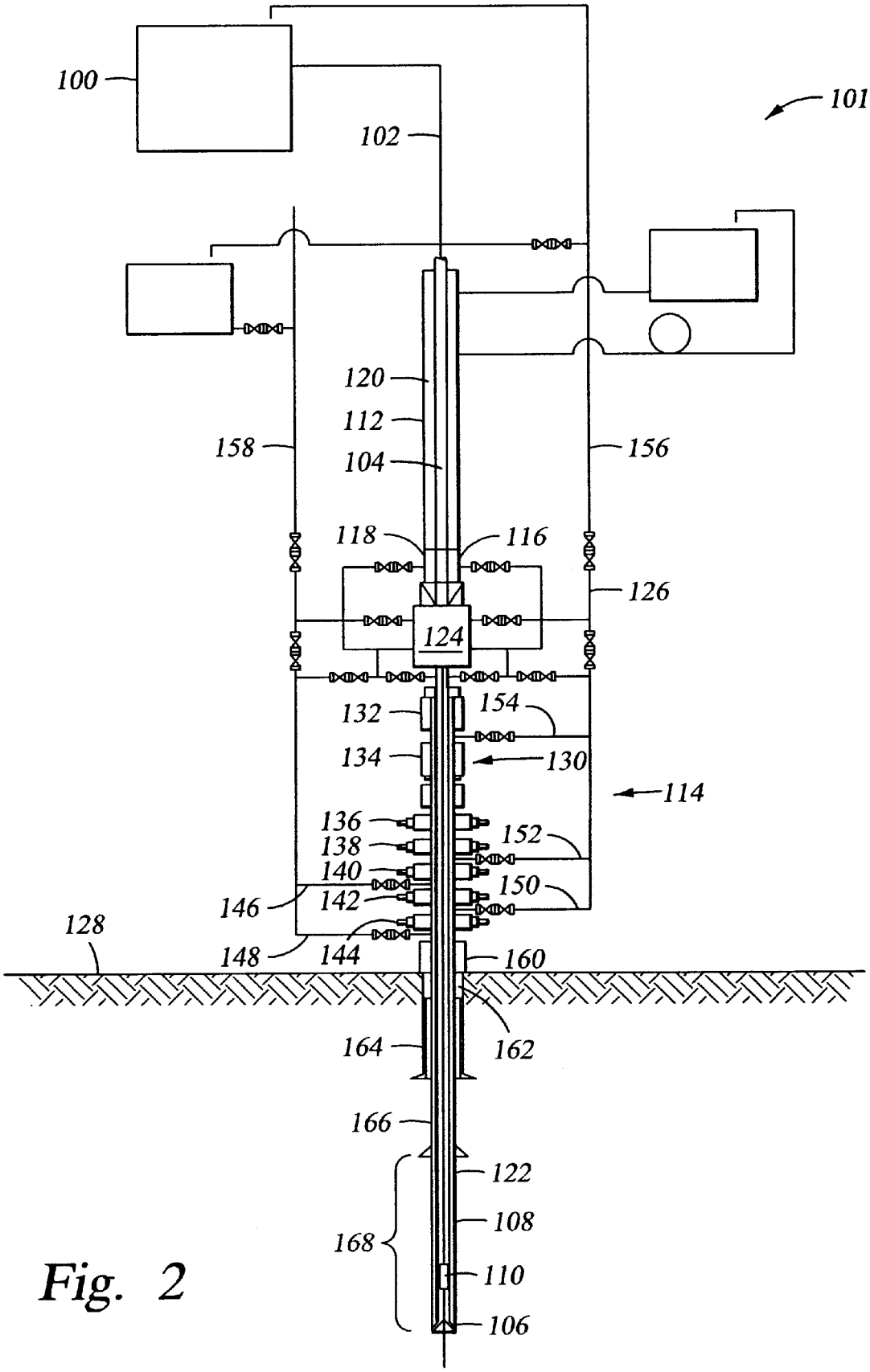
FIG. 2 shows an example of a typical system used in an embodiment of the invention.

FIG. 2 shows an example of a typical drilling system 101 used in an embodiment of the invention. The drilling system 101 presented in the example is provided for illustration of the methods used in the present invention and is not intended to limit the scope of the invention. The methods of the invention may function in arrangements that differ from the drilling system 101 shown in FIG. 2.

The drilling system 101 has a surface drilling mud circulation system 100 that includes a drilling mud storage tank (not shown separately) and surface mud pumps (not shown separately). The surface drilling mud circulation system 100 and other surface components of the drilling system 101 are located on a drilling platform (not shown) or a floating drilling vessel (not shown). The surface drilling mud circulation system 100 pumps drilling mud through a surface pipe 102 into a drill string 104. The drill string 104 may include drill pipe (not shown), drill collars (not shown), a bottom hole assembly (not shown), and a drill bit 106 and extends from the surface to the bottom of a well 108. The drill string 104 may also include a drill string valve 110.

The drilling system 101 may include a marine riser 112 that extends from the surface to a subsea wellhead assembly 114. The marine riser 112 forms an annular chamber 120 that is typically filled with seawater. A lower end of the marine riser 112 may be connected to a subsea accumulator chamber ("SAC") 116. The SAC 116 may be connected to a subsea rotating diverter (SRD) 118. The SRD 118 functions to rotatably and sealingly engage the drill string 104 and separates drilling mud in a wellbore annulus 122 from seawater in an annular chamber 120 of the marine riser 112.

A discharge port of the SRD 118 may be connected to an inlet of a subsea mudlift pump ("MLP") 124. An outlet of the MLP 124 is connected to a mud return line 126 that returns drilling mud from the wellbore annulus 122 to the surface drilling mud circulation system 100. The MLP 124 typically operates in an automatic rate control mode so that an inlet pressure of the MLP 124 is maintained at a constant level. Typically, the MLP 124 inlet pressure is maintained at a level equal to the seawater hydrostatic pressure at the depth of the MLP 124 inlet plus a differential pressure that may be, for example, 50 psi. However, the MLP 124 pumping rate may be adjusted so that back pressure may be generated in the wellbore annulus 122. The MLP 124 may be a centrifugal pump, a triplex pump, or any other type of pump known in the art that may function to pump drilling mud from the seafloor 128 to the surface. Moreover, the MLP 124 may be powered by any means known in the art. For example, the MLP 124 may be powered by a seawater powered turbine or by seawater pumped under pressure from an auxiliary pump.

The inlet of the MLP 124 may be connected to a top of a blowout preventer stack 130. The BOP stack 130 may be of any design known in the art and may contain several different types of BOP. As an example, the BOP stack 130 shown in FIG. 2 includes an upper annular BOP 132, a lower annular BOP 134, an upper casing shear ram preventer 136, a shear ram preventer 138, and upper, middle, and lower pipe ram preventers 140, 142, and 144. The BOP stack 130 may have a different number of preventers if desired, and the number, type, size, and arrangement of the blowout preventers is not intended to limit the scope of the invention.

The BOP stack 130 also includes isolation lines such as lines 146, 148, 150, 152, and 154 that permit drilling mud to be circulated through choke/kill lines 156 and 158 after any of the BOPs have been closed. The isolation lines (146, 148, 150, 152, and 154) and choke/kill lines (156 and 158) may be selectively opened or closed. The isolation lines (146, 148, 150, 152, and 154) and the choke/kill lines (156 and 158) are important to the function of the invention because drilling mud must be able to flow in a controlled manner from the surface, through the well, and back after the BOPs are closed.

A lower end of the BOP stack 130 may be connected to a wellhead connector 160 that may be attached to a wellhead housing 162 positioned near the seafloor 128. The wellhead housing 162 is typically connected to conductor pipe (also referred to as conductor casing) 164 that is cemented in place in the well 108 near the seafloor 128. Additional casing strings, such as casing string 166, may be cemented in the well 108 below the conductor pipe 164. Furthermore, additional casing and liners may be used in the well 108 as required.

When drilling a wellbore 168, kicks may be encountered when formation fluid pressure is greater than a hydrostatic pressure in the wellbore 168. When a kick is detected, the aforementioned dynamic shut-in process is initiated and completed so that a kick intensity may be determined. The kick intensity may be defined as, for example, a volume of formation fluid that enters the wellbore 168 or as an excess of formation fluid (or "pore") pressure above a fluid pressure in the wellbore 168. However, the determination of the kick intensity may be complicated by the presence of a DSV 110 in the drill string 104. For example, a spring in the DSV 110 must be adjusted correctly so that it will activate the flow cone and block the flow ports when pump pressure is removed from the mud column in the drill string 104 such as by stopping the pumps. If the flow ports remain at least partially open, the well will continue to flow after the pumps have been shut down and the well 108 has been fully shut-in. The DSV 110 may develop leaks from flow erosion or corrosion, among other causes. Therefore, it may be difficult to determine if flow in the well experienced after the pumps are shut down and the well is fully shut-in is due to a leaking or partially open DSV 110, or is due to additional influx that has entered the well 108. Continued flow may also make it difficult or impossible to calculate the volume of the kick or the drilling mud density required to effectively counteract the elevated formation pressure. Therefore, knowledge of whether the DSV 110 is leaking is important to well control procedures taken after the well 108 is fully shut-in. A method for detecting a leak in a DSV 110 is disclosed in co-pending U.S. application Ser. No. 09/730,891, titled "Method for Detecting a Leak in a Drill String Valve," filed on even date herewith, assigned to the assignee of the present invention, and incorporated by reference herein.

While circulating and drilling, a hydrostatic pressure exerted by the drilling mud in the annulus 122, in addition to an annular friction pressure ("AFP") generated by the surface pump and an inlet pressure maintained by the MLP 124, contribute to a bottom hole pressure ("BHP") that opposes formation pore pressures encountered near a bottom of the well 108. The AFP is a pressure loss experienced (when the surface pumps are running) because of the friction between the drilling mud and annular surfaces (outer walls of the drill string 104 and inner walls of the well 108). Different drilling environments involve both overbalanced and underbalanced drilling operations, but kicks in both situations result from formation pore pressures that are higher than the BHP exerted by the fluid column. As previously, described, the MLP 124 inlet pressure is maintained at a level substantially equal to the seawater hydrostatic pressure ("SWH") at the depth of the MLP 124 inlet plus a selected differential pressure that may be, for example, a nominal amount such as 50 psi. Simultaneously, the MLP 124 maintains an outlet pressure sufficient to pump drilling mud from the seafloor 128 to the surface. A drill pipe pressure ("DPP") is maintained by the surface drilling mud pumps to circulate drilling mud through the drill string 104, through the drill bit 106, and into the wellbore annulus 122. The MLP 124 inlet pressure may be electronically monitored from the surface through a gauge (not shown) located in or near the inlet of the subsea MLP 124.

At the conclusion of the dynamic shut-in procedure (as disclosed in the copending application described above), a dynamic underbalance pressure ("DUP") is established. The DUP is equivalent to a conventional shut-in drill pipe pressure ("SIDP") minus the AFP. The DUP and the AFP are then used to determine the equivalent of the conventional SIDP:

$$SIDP=DUP+AFP.$$

The SIDP is then used to calculate a kill mud weight ("KMW"). The KMW may be defined as a drilling mud density required to at least balance an elevated formation pore pressure that induced the kick in the well 108.

Note that the SIDP is also a full underbalance pressure ("FUP") as well as the kick intensity based on pressure. Each is defined as an excess of formation fluid (pore) pressure over the BHP that existed prior to the kick with the surface pumps shut off, the U-tube balanced (or the DSV 110 holding), and the MLP 124 inlet pressure at the normal SWH plus the nominal differential pressure. Under those conditions, the BHP would be the sum of the MLP 124 inlet pressure and the hydrostatic pressure of the original mud in the annulus 122.

After a well has been dynamically shut-in, pressures measured, and the KMW calculated, a procedure may be initiated to kill the well 108. The procedure may be different when there is and when there is not a DSV 110 in the drill string 104. The two procedures (one without the DSV 110 and one with the DSV 110) are described in detail below.

Procedure for Killing the Well when A DSV is Not Used in the Drill String

Stage 1: Full Shut-In

After the well 108 has been dynamically shut-in (as shown in block 200 of FIG. 4), a full shut-in of the well (108 in FIG. 2) is begun by stopping the surface mud pumps. Full well shut-in is shown as block 210 in FIG. 4. When the surface pumps are shut-down, the fluid level begins to fall in the drill pipe because of the unbalanced U-tube. In order to prevent further flow, the MLP (124 in FIG. 2) inlet pressure may be increased by an amount at least equal to the AFP. Because the MLP (124 in FIG. 2) is still running, the U-tube will flow in a controlled manner. After the U-tube reaches equilibrium, the MLP (124 in FIG. 2) may be shut down and the MLP (124 in FIG. 2) inlet pressure may be measured. If the measured shut-in MLP (124 in FIG. 2) inlet pressure is greater than the MLP (124 in FIG. 2) inlet pressure held during the U-tube procedure, then either the well (108 in FIG. 2) flowed during the U-tube procedure or the AFP was underestimated. If the well (108 in FIG. 2) did not flow during the U-tube and the shut-in MLP (124 in FIG. 2) inlet pressure is higher than that held during the U-tube, a more accurate estimate of the AFP may be determined from the increase in the MLP (124 in FIG. 2) inlet pressure. Before beginning to "circulate out" the kick, an alternate method of estimating the FUP (on which to base the KMW) may be performed.

After the well is fully shut-in and pressures are stabilized, the drill string (104 in FIG. 2) may be held in a stationary position in the well (108 in FIG. 2) (wherein the bit (106 in FIG. 2) is lifted off of a well bottom) and, as an option, the fluid level in the drill pipe may be measured with a device such as an Echo-meter. The fluid level may be used to produce an alternate estimate of the FUP or the SIDP (as defined above) for the kick in the well (108 in FIG. 2). The FUP may be verified with the equation:

$$FUP=\Delta M/W-(FL\times Gm),$$

where $$\Delta M/W=(Gm-Gw)\times WD.$$

"ΔM/W" may be defined as a hydrostatic pressure differential that is produced by a difference in densities of mud and seawater from the surface to the "mud line." The mud line may be defined as the point at which the SRD (118 in FIG. 2) separates drilling mud in the wellbore annulus (122 in FIG. 2) from seawater in the annulus (120 in FIG. 2) of the marine riser (112 in FIG. 2). In effect, the hydrostatic pressure in the wellbore is reduced by the amount of the ΔM/W because the pressure at the MLP (124 in FIG. 2) inlet is maintained essentially at the seawater hydrostatic pressure (SWH). "Gm" is a gradient of the drilling mud, "Gw" is a gradient of the seawater, "WD" is a water depth, and "FL" is a fluid level in the drill pipe. The gradients reflect magnitudes of pressure changes in a fluid column with respect to depth. For example, the seawater gradient (Gw) differs from the drilling mud gradient (Gm) because a density of the drilling mud may be greater than a density of the seawater. Therefore, as depth is increased, a column of more dense drilling mud may exhibit a greater hydrostatic pressure than an equivalent vertical depth column of seawater. The gradients reflect these fluid properties as a pressure change per foot of fluid level.

Stage 2: Influx Gradient and Volume Calculations

Figure 4:
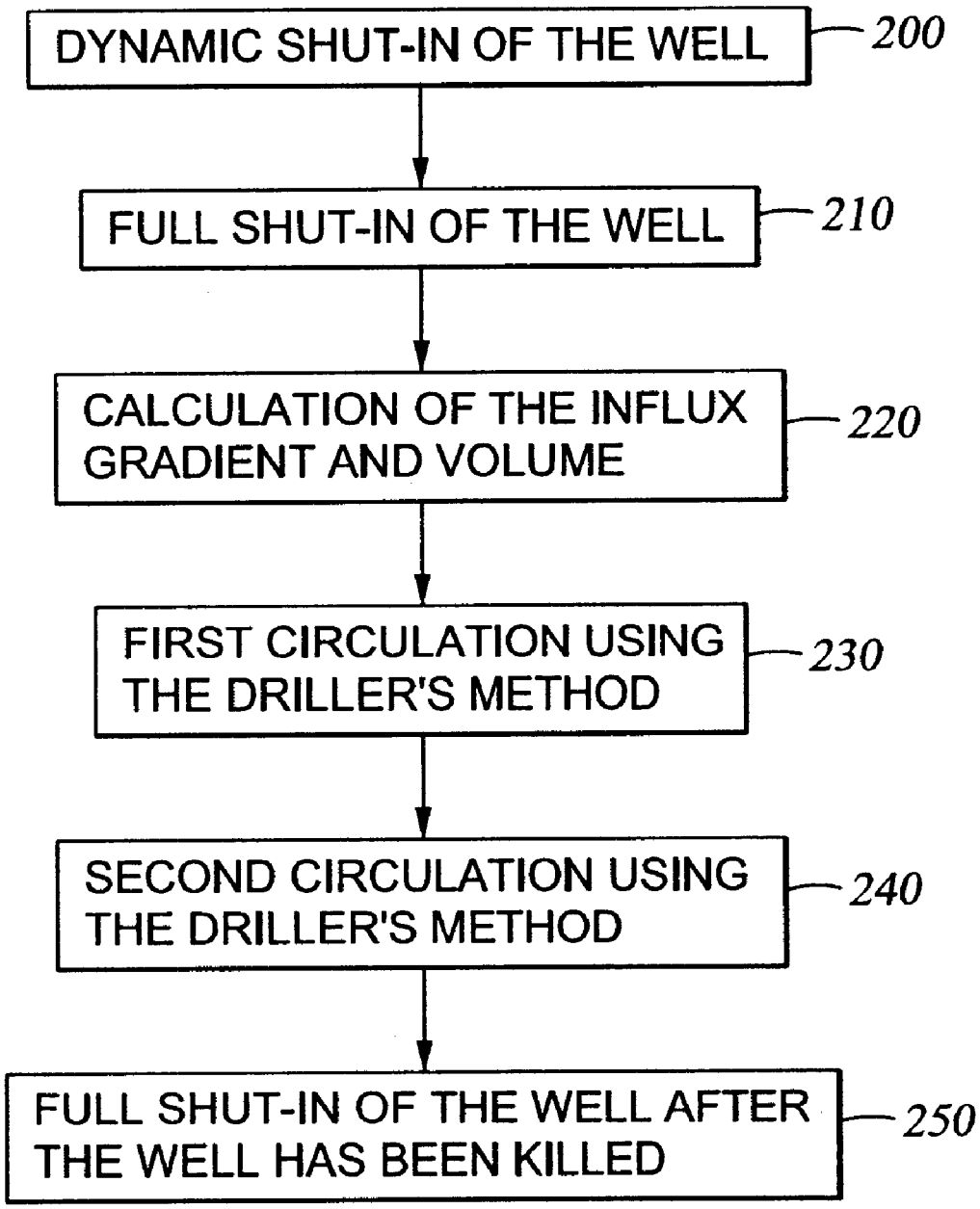
FIG. 4 shows a flow chart of method elements included in an embodiment of the invention.

A reasonable step in the well kill procedure is to calculate an influx gradient and/or volume as shown in block 220 of FIG. 4. However, these calculations can be made while circulating the influx out of the well (108 in FIG. 2) and they should not delay the process.

Surface mud system storage tanks are also known as "pits." If a fluid influx has entered a well (108 in FIG. 2), a mud volume in the pits, measured after the dynamic shut-in procedure, may be greater than the volume contained in the pits while circulating prior to the kick. The increase in mud volume is the "pit gain." After the U-tube has reached equilibrium and the well (108 in FIG. 2) has been fully shut-in, actual (measured) and theoretical (based upon a geometry of the drill string (104 in FIG. 2)) U-tube mud pit volume increases may be compared to detect and measure any additional flow that occurred during the U-tube to arrive at a final total pit gain.

Measurement of the pit gain and an analysis of the annular geometry of the well (108 in FIG. 2) may enable a calculation of the kick, or influx, gradient ("Gi"). Determination of Gi is important because the type of fluid entering the well as the kick influx fluid can be postulated from it. For example, gas produces higher wellbore pressures while oil may be more difficult to dispose of at the surface. Gi may be calculated as:

$$Gi=Gm-(SICP-SIDP)\div HI.$$

"SICP" is a shut-in casing pressure and is equal to the increase in the MLP (124 in FIG. 2) inlet pressure above the pre-kick level. "SIDP" is a shut-in drill pipe pressure and is equal to the full underbalance pressure (FUP). "HI" is a height of the influx, and:

$$HI=\text{Pit Gain/Annular Capacity},$$

where the pit gain is measured in barrels (bbls) and the annular capacity of the wellbore annulus (122 in FIG. 2) is measured in barrels per foot (bbls/ft).

Alternatively, Gi may be assumed and the kick volume may be determined by first calculating HI, then multiplying HI by the annular capacity of the wellbore annulus (122 in FIG. 2):

$$HI=(SICP-SIDP)\div(Gm-Gi),$$

and $$\text{Kick Volume}=HI\times\text{Annular Capacity}.$$

If the pit gain is incorrectly measured, the calculated Gi may be incorrect. For example, Gi may be calculated to be negative or to be larger than a maximum gradient possible of 0.5 psi/ft. Therefore, the calculation of the kick volume to verify the measured pit gain is generally more useful.

As mentioned above, these calculations may be made while further steps are taken to control the well (108 in FIG. 2). The process of killing the well should not be delayed while the calculations are completed.

Stage 3: First Circulation of the Well Using the Driller's Method

After the SIDP (also called the FUP) has been determined during the dynamic shut-in procedure and confirmed during the full shut-in procedure, and after the KMW has been calculated, procedures should be initiated for circulating the kick out of the well (108 in FIG. 2) without waiting for influx gradient/kick volume calculations to be made. The recommended method for circulating the kick out of the well is the Driller's Method, as shown in block 230 of FIG. 4. The Driller's Method is preferred in Subsea Mudlift Drilling ("SMD") for several reasons:

- Except in shallow water and in long, open hole sections of a wellbore, a drill pipe volume will often be greater than an open hole volume, negating pressure improvement produced by the Wait and Weight Method at the weak point in the open hole section (typically located at an end of a lowermost casing string).
- Due to greater water and drilling depths, plus mud line pressure control, there may be relatively little gas expansion and pressure increase while the kick is in the wellbore below the MLP.
- SMD wells typically have greater pressure margins than conventional subsea wells.
- Initiating the circulation of the kick out of the wellbore is typically faster and less complicated.
- The Driller's Method provides an alternative to depending solely on a calculated Drill Pipe Pressure Decline Schedule.

Implementing the Driller's Method involves several steps and calculations. First, the KMW may be calculated as:

$$KMW=OMW+FUP\div(0.052\times(TD-WD)).$$

"OMW" is an original drilling mud weight (a pre-kick mud weight), "TD" is a total depth of the well (108 in FIG. 2) below the drilling platform or vessel (typically measured below a "rig floor"), and, as defined above, "WD" is the water depth. Next, an initial circulating pressure ("ICP") for circulating the kick out of the well (108 in FIG. 2) may be calculated as:

$$ICP=\text{Pre-Kick Circulating Drill Pipe Pressure}+FUP.$$

If the actual KMW is increased above the KMW calculated in the previous equation to include a "trip margin," any overbalance pressure may appear in the BHP as the drill pipe is filled with KMW drilling mud (refer to Stage 4 below) or while the wellbore annulus (122 in FIG. 2) is being displaced (refer to Optional Stage 4 below). The trip margin may be included to help reduce any "swabbing" effect produced by the removal of the drill string (104 in FIG. 2) from the well (108 in FIG. 2), but should generally be deferred until the influx is out of the well (108 in FIG. 2). Swabbing refers to the pressure reduction that may occur in the wellbore (168 in FIG. 2) when drilling mud is "pulled" toward the surface as the drill string (104 in FIG. 2) is removed from the well (108 in FIG. 2). Swabbing of the well may decrease BHP and may result in a kick.

After the KMW and the ICP have been calculated, the MLP (124 in FIG. 2) inlet pressure is set at the stabilized shut-in pressure determined at the completion of the full shut-in procedure. At this setting, the MLP (124 in FIG. 2) inlet pressure consists of the seawater hydrostatic pressure (SWH), plus the full underbalance pressure (FUP) and an initial hydrostatic loss due to the influx. The surface mud pumps are then activated and set to a preselected kick circulating rate ("KCR"). The KCR may be an original drilling pump rate that was used prior to the influx or another preselected value. As the surface pumps are set to the KCR, the MLP (124 in FIG. 2) inlet pressure is held constant at the shut-in level. Thus, after pump start-up the BHP is composed of a sum of a formation fluid (pore) pressure and the annular friction pressure (AFP), which corresponds to the chosen KCR. If the KCR is substantially equal to the pre-kick drilling pump rate, the AFP may remain substantially constant.

As the surface pumps reach the KCR, the MLP (124 in FIG. 2) inlet pressure may be reduced in a controlled procedure. As a first option, the MLP (124 in FIG. 2) inlet pressure may be reduced by an amount substantially equal to the AFP when the surface pumps are started in order to hold the BHP substantially equal to the formation pore pressure. A second option is to hold the MLP (124 in FIG. 2) rate constant until a preselected back pressure is imposed on the BHP. The back pressure may help prevent flow caused by gas expansion in the well (108 in FIG. 2). After a preselected back pressure is generated, the MLP (124 in FIG. 2) inlet pressure may then be reduced by an amount substantially equal to the AFP. The following discussions assume that neither of these two options to reduce the MLP (124 in FIG. 2) inlet pressure was adopted.

The surface pumps will begin to fill the drill pipe at a constant pump rate (typically the KCR). The drill pipe will have to be completely filled (to account for the drop in the FL experienced because of the flow of the unbalanced U-tube) before a drill pipe pressure (DPP) measurement may be recorded. When the DPP may be measured and stabilizes at the calculated ICP, the MLP (124 in FIG. 2) may be switched to manual control and a MLP (124 in FIG. 2) pump rate may be adjusted to maintain the DPP at a substantially constant pressure (typically the ICP) until the kick has been circulated out of the well (108 in FIG. 2) and clean OMW drilling mud is returning to the surface.

If the DPP does not stabilize at the calculated ICP, circulation should continue and the stabilized DPP may serve as a new ICP. This step should be taken because if the drill string (104 in FIG. 2) has become partially plugged during shut-down and restart, pumping at the originally calculated ICP may cause a drop in the BHP and may permit the well to flow in an uncontrolled manner. The MLP (124 in FIG. 2) may be adjusted through manual control procedures to assist in maintaining the new ICP as the surface pump rate is maintained at the KCR.

While the kick is being circulated out of the well, at least one surface mud tank (not shown) in the surface mud circulation system (100 in FIG. 2) should be isolated and a mud density in the isolated tank should be increased to the KMW. If the surface mud circulation system (100 in FIG. 2) is not configured so that drilling mud may be changed to the KMW while circulating, another full shut-in procedure may be completed (after the influx has been circulated out) and the system restarted when the KMW drilling mud is ready for circulation. After the kick has been completely circulated out of the well (108 in FIG. 2), the MLP (124 in FIG. 2) inlet pressure may be recorded and a final circulating pressure ("FCP") should be calculated as:

$$FCP=(\text{Original Total Friction}-AFP)\times(KMW/OMW)+AFP-\Delta M/W_{KMW},$$

where $$\text{Original Total Friction}=DPP_{pre\text{-}kick}+\Delta M/W_{OWM}.$$

"$DPP_{pre\text{-}kick}$" is the pre-kick drill pipe pressure and "$\Delta M/W_{OMW}$" is the hydrostatic pressure differential calculated with the OMW gradient, Gm. "$\Delta M/W_{KMW}$" is a new hydrostatic pressure differential calculated with a kill mud weight gradient, Gk, that is characteristic of the KMW. AFP is the annular friction pressure.

As the influx is pumped up the annulus (122 in FIG. 2) in the first circulation, the MLP (124 in FIG. 2) inlet pressure will rise due to gas expansion and consequent additional loss of hydrostatic pressure until the influx reaches the MLP (124 in FIG. 2). As the influx passes through the MLP (124 in FIG. 2) and out of the well (108 in FIG. 2), the MLP (124 in FIG. 2) inlet pressure falls to the sum of the SWH and the FUP. At a constant pump kick circulating rate (KCR) and initial circulating pressure (ICP), the MLP (124 in FIG. 2) inlet pressure will remain substantially constant at this level until the mud weight is changed. The first circulation is complete when clean OMW drilling mud reaches the surface.

Stage 4: Second Circulation of the Driller's Method Using A Drill Pipe Pressure Decline Schedule Drilling mud at the KMW may be circulated to the bit (106 in FIG. 2) in a second circulation of the Driller's Method, as shown in block 240 of FIG. 4. For example, drilling mud at the KMW may be circulated to the bit (106 in FIG. 2) following a drill pipe pressure decline schedule. Drill pipe pressure decline schedules are known in the art and may be calculated using well parameters such as well depth, well geometry, and the KMW. Drill pipe pressure decline schedules typically maintain the BHP at a preselected level above the formation pore pressure while the drill pipe is filled with KMW drilling mud. The preselected level may be generally equal to the AFP of the subsea system. However, the preselected level may be a different value and is not intended to limit the scope of the invention.

Because kill circulation may occur at relatively high pump rates, friction pressure drops in the subsea mudlift drilling (SMD) system (101 in FIG. 2) may be substantially different than friction pressure drops in conventional drilling systems. For example, in conventional kick circulation the assumption that the drill string friction pressure drop is distributed linearly along the entire length of a drill string, including the bottom hole assembly and the bit, does not cause substantial error. In SMD system (101 in FIG. 2), the friction pressure drops in individual components of the drill string (104 in FIG. 2) may be much larger, causing greater errors due to non-linearity. Therefore, conventional linear drill pipe pressure reduction schedules may have to be modified for use in SMD wells.

After the KMW drilling mud reaches the bit (106 in FIG. 2), the DPP should be held constant at the final circulating pressure (FCP) with a substantially constant surface pump rate (the KCR) until the KMW drilling mud reaches the surface. The DPP may be held at the FCP by adjusting the MLP (124 in FIG. 2) inlet pressure while the surface pump rate is held substantially constant at the KCR. The pressures in the well (108 in FIG. 2) may remain substantially constant after the KMW drilling mud reaches the MLP (124 in FIG. 2) inlet. Moreover, as the wellbore annulus (122 in FIG. 2) is filled with KMW drilling mud, the MLP (124 in FIG. 2) inlet pressure will gradually fall to a level equal to the SWH that exists external to the MLP (124 in FIG. 2). The MLP (124 in FIG. 2) inlet pressure decrease, which may be substantially equal to the full underbalance pressure (FUP), will indicate that the FUP that has been maintained by the MLP (124 in FIG. 2) suction pressure has been replaced by a corresponding increase in the drilling mud hydrostatic pressure. However, the MLP (124 in FIG. 2) inlet pressure must still be maintained at least at the SWH in order to maintain MLP (124 in FIG. 2) operating integrity.

Also note that as the well (108 in FIG. 2) is filled with kill mud weight (KMW) drilling mud, the AFP may increase because of the increased mud density. Calculation of the increase in the AFP may become important if the mud density is high so that the increase in AFP is correspondingly large. For example, a relatively accurate knowledge of the AFP is helpful to explain MLP (124 in FIG. 2) inlet pressure behavior as the KMW drilling mud moves up the annulus (122 in FIG. 2) and nears the seafloor (128 in FIG. 2). The net effect of higher AFP developing as the KMW drilling mud is being pumped up the annulus (122 in FIG. 2) is that the MLP (124 in FIG. 2) inlet pressure must be lowered more rapidly to keep the DPP from increasing. Then, before the KMW drilling mud reaches the MLP (124 in FIG. 2), the MLP (124 in FIG. 2) inlet pressure will be lowered to a minimum level (which is substantially equal to the seawater hydrostatic pressure (SWI) plus a differential pressure that may be, for example, 50 psi), and thereafter the drill pipe pressure (DPP) will rise at the substantially constant KCR until the kill mud reaches the MLP (124 in FIG. 2), after which the DPP will remain substantially constant.

Stage 4 (Optional): Second Circulation of the Driller's Method with Constant Pressures An alternate procedure (for block 240 of FIG. 4) may be followed when circulating the KMW drilling mud through the drill pipe and back to the surface. After the kick is completely circulated out of the well (108 in FIG. 2) in Stage 3, KMW drilling mud may be circulated to the bit (106 in FIG. 2) while holding the MLP (124 in FIG. 2) inlet pressure substantially constant at a level established at the end of the first circulation (Stage 3). Recall that at this level, the MLP (124 in FIG. 2) inlet pressure is substantially equal to the SWH plus the FUP. When the KMW drilling mud reaches the bit (106 in FIG. 2), the DPP becomes the FCP (which should be equal to the preselected FCP) and should be held substantially constant for the remainder of the second circulation. The DPP may be maintained at the FCP by adjusting the MLP (124 in FIG. 2) inlet pressure while the surface pump rate is held substantially constant at the KCR. Note that once again, pressures in the well (108 in FIG. 2) may remain substantially constant after KMW drilling mud reaches the MLP (124 inlet in FIG. 2).

By holding the MLP (124 in FIG. 2) inlet pressure substantially constant while filling the drill pipe with KMW drilling mud and then holding the DPP substantially constant, the BHP may be maintained at the formation pore pressure plus the AFP throughout the well kill procedure as long as the wellbore annulus (122 in FIG. 2) is substantially clear of all gas influxes. Further, displacing the wellbore annulus (122 in FIG. 2) with KMW drilling mud at the FCP also allows the MLP (124 in FIG. 2) inlet pressure to fall to the SWH plus any selected differential pressure.

Stage 5: Full Shut-In After Kill

The well is dead after KMW drilling mud has been completely circulated through the system and has reached the surface while the MLP (124 in FIG. 2) inlet pressure is maintained at least at the SWH. The well may now be fully shut-in as shown in block 250 of FIG. 4. If the MLP (124 in FIG. 2) inlet pressure is held substantially constant at SWH and the surface pumps are shut down, the drilling mud will fall and "U-tube" until the well reaches equilibrium. Regardless of which pressure control method is used to circulate KMW drilling mud through the well (108 in FIG. 2), once the MLP (124 in FIG. 2) inlet pressure falls to SWH and the surface pumps are shut down, the same final shut-in conditions will exist and the well will be statically dead.

Procedure for Killing the Well when A DSV is Included in the Drill String

The procedures used for killing the well (108 in FIG. 2) both in the presence and absence of a DSV (110 in FIG. 2) are substantially similar. However, there are some differences that will be explained in detail below. Portions of the procedure that are identical to the procedure described above for use in the absence of a DSV (110 in FIG. 2) will be identified for simplicity. The following stages may be substituted for the previously described stages when following the procedure shown in blocks 200–250 of FIG. 4.

Full shut-in with the DSV (110 in FIG. 2) in the drill string (104 in FIG. 2) is very simple: all pumps are shut down. There is no U-tube to complicate the shut-in. Therefore, the kill procedure starts with Stage 1 below. At full shut-in, the DPP will bleed (or decrease) immediately to zero when a standpipe valve is opened to the mud pit. The shut-in MLP (124 in FIG. 2) inlet pressure consists of the seawater hydrostatic pressure (SWH) plus the shut-in casing pressure (SICP). The SICP equals the full underbalance pressure (FUP) plus a hydrostatic loss due to the influx.

Note that the steps presented in the previous procedure that are directed to calculating the shut-in drill pipe pressure (SIDP) by measuring the fluid level after the U-tube is completed are not required because the DSV (110 in FIG. 2) will prevent the U-tube flow from occurring when operating properly.

Stage 1 with DSV: Verify Shut-In Pressures

Figure 3:
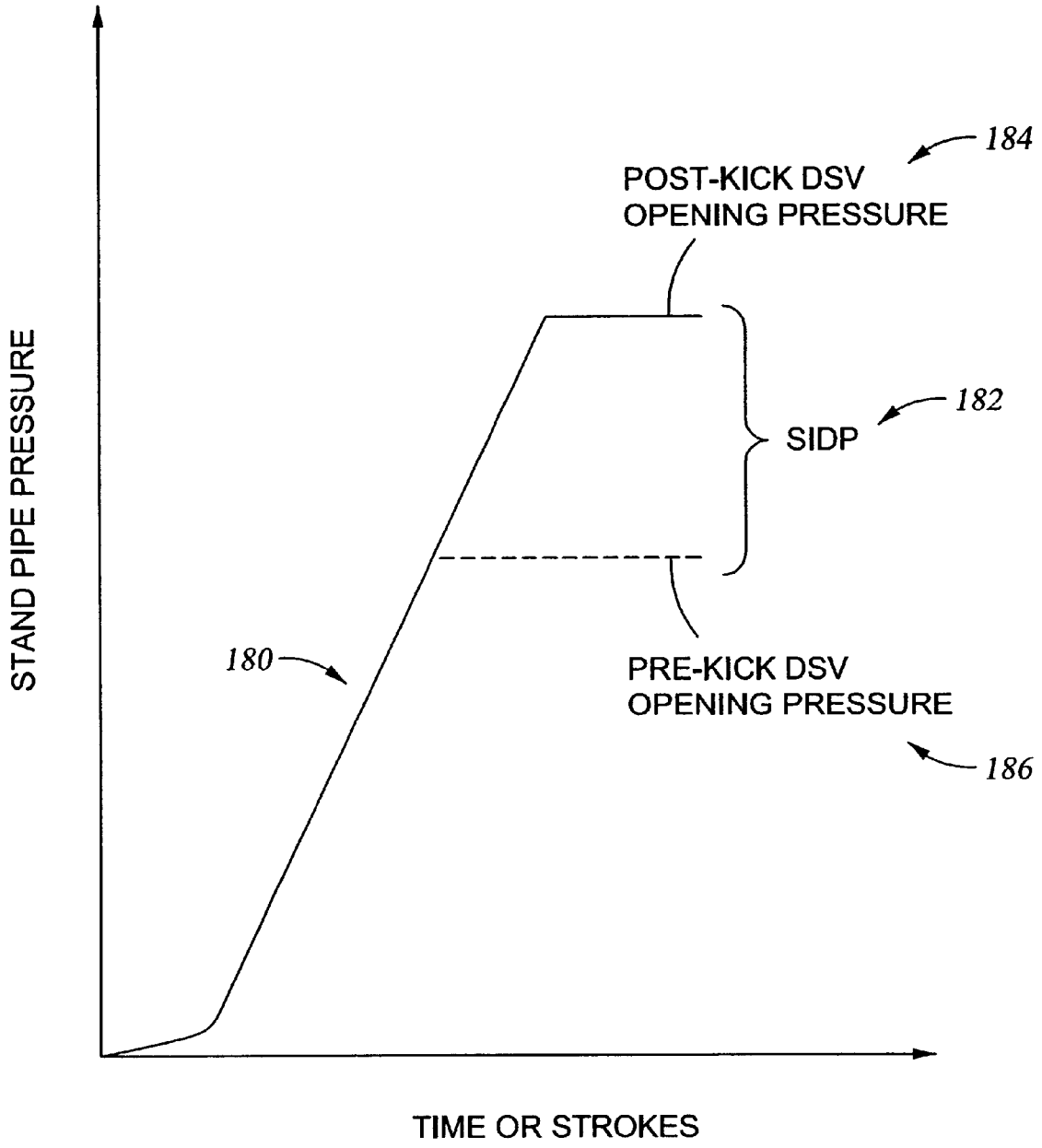
FIG. 3 shows a diagram of a change in drill string valve opening pressure after a formation fluid influx.

The first step in the kill procedure is to verify the shut-in drill pipe pressure (SIDP). Pressure may be slowly applied to the drill pipe using a pump such as a cement pump (not shown) located proximate the surface drilling mud circulation system (100 in FIG. 2). The pressure may increase until the DSV (110 in FIG. 2) opens or "cracks." When the DSV (110 in FIG. 2) opens, the DPP (180 in FIG. 3) may become substantially constant as shown in FIG. 3. As a result, the SIDP (182 in FIG. 3) is substantially equal to a pressure (184 in FIG. 3) required to open the DSV (110 in FIG. 2) after the kick enters the well (108 in FIG. 2) minus a pressure (186 in FIG. 3) required to open the DSV (110 in FIG. 2) before the kick enters the well (108 in FIG. 2). The SIDP (182 in FIG. 3) should be substantially equal to an increase in a DPP (180 in FIG. 3) recorded during the dynamic shut-in procedure plus the AFP. The SIDP (182 in FIG. 3) may be substantially equal to the kick intensity. The kick intensity in this context may be defined as an excess of pore pressure above the pre-kick bottom hole pressure (BHP) in the wellbore (168 in FIG. 2). In this case, the kick intensity is substantially equal to the BHP increase in the well (108 in FIG. 2).

Stage 2 with DSV: Influx Gradient and Volume Calculations

Stage 2 is substantially the same as Stage 2 in the previously described procedure, here there is no DSV, including the calculation of Gi, HI, and the kick volume.

Stage 3 with DSV: First Circulation of the Well Using the Driller's Method

Stage 3 is substantially the same as Stage 3 in the previously described procedure here there is no DSV. However, after the kick is circulated out of the well (108 in FIG. 2), a check may be performed to verify that the influx has been completely removed from the well (108 in FIG. 2). To verify that the influx has been circulated out, the following relationships should exist:

$$SIDP = BHP - DPH + DSV \text{ opening pressure} + DSV \text{ internal friction pressure};$$

and $$MLP \text{ inlet pressure} = BHP - \text{Wellbore annulus hydrostatic pressure},$$

where "DPH" is a drill pipe hydrostatic pressure. The DSV (110 in FIG. 2) internal friction pressure is an additional pressure required to overcome friction between internal components of the DSV (110 in FIG. 2) when the DSV (110 in FIG. 2) is opened.

Stage 4 and Optional Stage 4 with DSV: Second Circulation of the Driller's Method Stage 4 and Optional Stage 4 are substantially the same as Stage 4 and Optional Stage 4 in the previously described procedure where there is no DSV. However, if the kick intensity acting below the DSV (110 in FIG. 2) is not compensated for by the hydrostatic pressure produced by the OMW drilling mud in the drill string (104 in FIG. 2) above the DSV (110 in FIG. 2), the DSV (110 in FIG. 2) may not fully open as the kick is being circulated out of the well (108 in FIG. 2). If the DSV (110 in FIG. 2) does not open, the system (101 in FIG. 2) may be exposed to a "throttling" effect produced by the partially open DSV (110 in FIG. 2). Therefore, the system (101 in FIG. 2) may experience additional friction pressure that may complicate the well control procedure. The problem may be eliminated if the hydrostatic pressure generated by the KMW drilling mud fully opens the DSV (110 in FIG. 2). A higher KMW may be required if the calculated KMW is insufficient to generate the hydrostatic pressure required to fully open the DSV (110 in FIG. 2).

Stage 5 with DSV: Full Shut-In After Kill

Stage 5 is substantially the same as Stage 5 in the previously described procedure where there is no DSV. Once the well (108 in FIG. 2) is fully shut-in, as long as the DSV (110 in FIG. 2) is closed and is not leaking, the well (108 in FIG. 2) should only be exposed to the selected MLP (124 in FIG. 2) suction pressure in addition to the hydrostatic pressure in the annulus (122 in FIG. 2).

CONCLUSION

After the well has been killed, the kick has been controlled. Drilling operations may resume or the drill string (104 in FIG. 2) may be tripped out of the well (108 in FIG. 2). The dynamic shut-in and well kill procedures permit operators to safely and efficiently control kicks in deep water wells that use Subsea Mudlift Drilling procedures and apparatus.

Those skilled in the art will appreciate that other embodiments of the invention can be devised which do not depart from the spirit of the invention as disclosed herein. Accordingly, the scope of the invention should be limited only by the attached claims.

What is claimed is:

1. A method for controlling a subsea well, the method comprising:

shutting at least one blowout preventer;

opening at least one isolation line;

circulating a formation fluid influx out of a well while an inlet pressure of a subsea mudlift pump is adjusted to maintain a drill pipe pressure at a substantially constant initial circulating pressure;

pumping drilling mud with a kill mud weight from a water surface into the well;

reducing the drill pipe pressure according to a preselected drill pipe pressure decline schedule until the kill mud weight drilling mud reaches a bottom of the well;

maintaining the drill pipe pressure at a substantially constant final circulating pressure after the kill mud weight drilling mud reaches the bottom of the well by adjusting the inlet pressure of the subsea mudlift pump; and circulating the kill mud weight drilling mud from the bottom of the well to the water surface while maintaining the substantially constant final circulating pressure.

2. The method of claim 1, wherein the initial circulating pressure is calculated by combining a pre-influx circulating pressure in the drill pipe and a full underbalance pressure.

3. The method of claim 2, wherein the full underbalance pressure is calculated after the well is dynamically shut-in.

4. The method of claim 1, wherein the final circulating pressure is calculated after the influx is completely circulated out of the well.

5. The method of claim 1, wherein the pumping is performed by a surface mud pump.

6. The method of claim 1, wherein the initial circulating pressure is maintained by setting a surface pump at a preselected kick circulating rate.

7. The method of claim 6, wherein the kick circulating rate comprises a pre-influx surface pump rate.

8. The method of claim 1, wherein the inlet pressure of the subsea mudlift pump is adjusted to remain substantially constant at a shut-in pressure when the drill pipe pressure is adjusted to be substantially equal to the initial circulating pressure.

9. The method of claim 8, wherein the inlet pressure of the subsea mudlift pump comprises an annular friction pressure.

10. The method of claim 1, wherein the inlet pressure of the subsea mudlift pump is reduced by an amount substantially equal to an annular friction pressure as a surface mud pump is set at a kick circulating rate.

11. The method of claim 1, wherein a rate of the subsea mudlift pump is maintained at a preselected level until a preselected back pressure is generated in the well, wherein the inlet pressure of the subsea mudlift pump is subsequently reduced by an amount substantially equal to an annular friction pressure as a surface mud pump is set at a kick circulating rate.

12. The method of claim 1, wherein when the drill pipe pressure is substantially equal to the initial circulating pressure, a rate of the subsea mudlift pump is adjusted to keep the drill pipe pressure substantially equal to the initial circulating pressure until the influx is completely circulated out of the well.

13. The method of claim 1, wherein a magnitude of the influx is calculated by determining a height of a formation fluid influx in the well.

14. The method of claim 1, wherein a magnitude of the influx is calculated by estimating a formation fluid influx gradient.

15. The method of claim 1, wherein a magnitude of the influx is calculated by determining a volume of a formation fluid influx.

16. The method of claim 1, wherein a magnitude of the influx is calculated by comparing a pre-influx and a post-influx opening pressure for a drill string valve.

17. The method of claim 1, wherein the kill mud weight is selected to at least balance a formation pore pressure.

18. The method of claim 1, wherein the kill mud weight is selected so that sufficient hydrostatic pressure is generated to open a drill string valve.

19. The method of claim 1, wherein the kill mud weight is selected to include a trip margin.

20. The method of claim 1, wherein the influx is circulated out of the well in a first circulation cycle of a driller's method.

21. The method of claim 1, wherein the kill mud weight drilling mud is circulated into the well in a second cycle of a driller's method.

22. The method of claim 1, wherein the drill pipe pressure decline schedule has been modified for use in subsea mudlift drilling system wells.

23. A method for controlling a subsea well, the method comprising:

shutting at least one blowout preventer;

opening at least one isolation liner;

circulating a formation fluid influx out of a well while an inlet pressure of a subsea mudlift pump is adjusted to maintain a drill pipe pressure at a substantially constant initial circulating pressure;

pumping drilling mud with a kill mud weight from a water surface into the well;

holding the inlet pressure of the subsea mudlift pump substantially constant until the kill mud weight drilling mud reaches a bottom of the well;

adjusting the inlet pressure of the subsea mudlift pump to maintain the drill pipe pressure at a substantially constant final circulating pressure after the kill mud weights drilling mud reaches the bottom of the well; and circulating the kill mud weight drilling mud from the bottom of the well to the water surface while maintaining the substantially constant final circulating pressure.

24. The method of claim 23, wherein the initial circulating pressure is calculated by combining a pre-influx circulating pressure in the drill pipe and a full underbalance pressure.

25. The method of claim 24, wherein the full underbalance pressure is calculated after the well is dynamically shut-in.

26. The method of claim 23, wherein the final circulating pressure is calculated after tie influx is completely circulated out of the well.

27. The method of claim 23, wherein the pumping is performed by a surface mud pump.

28. The method of claim 23, wherein the initial circulating pressure is maintained by setting a surface pump at a preselected kick circulating rate.

29. The method of claim 28, wherein the kick circulating rate comprises a pre-influx surface pump rate.

30. The method of claim 23, wherein the inlet pressure of the subsea mudlift pump is adjusted to remain substantially constant at a shut-in pressure when the drill pipe pressure is adjusted to be substantially equal to the initial circulating pressure.

31. The method of claim 30, wherein the inlet pressure of the subsea mudlift pump comprises an annular friction pressure.

32. The method of claim 23, wherein the inlet pressure of the subsea mudlift pump is reduced by an amount substantially equal to an annular friction pressure as a surface mud pump is set at a kick circulating rate.

33. The method of claim 23, wherein a rate of the subsea mudlift pump is maintained at a preselected level until a preselected back pressure is generated in the well, wherein the inlet pressure of the subsea mudlift pump is subsequently reduced by an amount substantially equal to an annular friction pressure as a surface mud pump is set at a kick circulating rate.

34. The method of claim 23, wherein when the drill pipe pressure is substantially equal to the initial circulating pressure, a rate of the subsea mudlift pump is adjusted to keep the drill pipe pressure substantially equal to the initial circulating pressure until the influx is completely circulated out of the well.

35. The method of claim 23, wherein a magnitude of the influx is calculated by determining a height of a formation fluid influx in the well.

36. The method of claim 23, wherein a magnitude of the influx is calculated by estimating a formation fluid influx gradient.

37. The method of claim 23, wherein a magnitude of the influx is calculated by determining a volume of a formation fluid influx.

38. The method of claim 23, wherein a magnitude of the influx is calculated by comparing a pre-influx and a post-influx opening pressure for a drill string valve.

39. The method of claim 23, wherein the kill mud weight is selected to at least balance a formation pore pressure.

40. The method of claim 23, wherein the kill mud weight is selected so that sufficient hydrostatic pressure is generated to open a drill string valve.

41. The method of claim 23, wherein the kill mud weight is selected to include a trip margin.

42. The method of claim 23, wherein the influx is circulated out of the well in a first circulation cycle of a driller's method.

43. The method of claim 23, wherein the kill mud weight drilling mud is circulated into the well in a second cycle of a driller's method.

44. The method of claim 23, wherein the drill pipe pressure is reduced according to a preselected drill pipe pressure decline schedule.

45. The method of claim 44, wherein the drill pipe pressure decline schedule has been modified for use in subsea mudlift drilling system wells.

* * * * *

UNITED STATES PATENT AND TRADEMARK OFFICE

CERTIFICATE OF CORRECTION

PATENT NO. : 6,474,422 B2
DATED : November 5, 2002
INVENTOR(S) : Schubert et al.

It is certified that error appears in the above-identified patent and that said Letters Patent is hereby corrected as shown below:

Column 15,
Lines 48 and 53, replace “here” with -- where --

Column 18,
Line 31, replace “tie” with -- the --

Signed and Sealed this

Twenty-fifth Day of March, 2003

JAMES E. ROGAN
*Director of the United States Patent and Trademark Office*